US006477779B1

(12) United States Patent
Slates

(10) Patent No.: US 6,477,779 B1
(45) Date of Patent: Nov. 12, 2002

(54) LATERAL ADJUSTMENT ARCHERY BOW SIGHT

(75) Inventor: Scott O. Slates, St. Charles County, MO (US)

(73) Assignee: Toxonics Manufacturing, Inc., Wentzville, MO (US)

( * ) Notice: Subject to any disclaimer, the term of this patent is extended or adjusted under 35 U.S.C. 154(b) by 65 days.

(21) Appl. No.: 09/678,244

(22) Filed: Oct. 4, 2000

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | |
|---|---|---|---|---|
| 4,020,560 A | * | 5/1977 | Heck | 33/265 |
| 5,289,814 A | * | 3/1994 | Maisano | 124/87 |
| 5,384,966 A | * | 1/1995 | Gibbs | 124/87 |
| 5,414,936 A | | 5/1995 | Sappington | |
| 5,428,901 A | | 7/1995 | Slates | |
| 5,524,601 A | | 6/1996 | Slates et al. | |
| 5,657,740 A | | 8/1997 | Slates et al. | |
| 5,694,698 A | | 12/1997 | Slates | |
| 5,722,175 A | | 3/1998 | Slates | |

* cited by examiner

*Primary Examiner*—Diego Gutierrez
*Assistant Examiner*—Madeline Gonzalez
(74) *Attorney, Agent, or Firm*—Paul M. Denk

(57) ABSTRACT

A translatable archery bow sight assembly that allows the sight to be vertically adjusted with a rotating shaft located within a vertically oriented carriage thereby protecting the shaft, rotation of the shaft causing a sight bracket to raise and lower whereby the sight bracket is adapted for receiving a sight pin, the shaft being rotated by a knob, and the knob including a polymeric bushing in contact with the carriage, the archery bow sight assembly including a stop means for retarding the movement of the pin, the stop means, for example, being surface features included in the knob such as notches which mate with a ball and a spring located within a bore in the carriage. The sight bracket is closely fitted around the carriage and includes bracket sleeves and rubber gaskets to insure a tight fit between the sight bracket and carriage. The sight bracket also includes a pin and a tongue, the tongue being threadedly engaged with the rotating shaft such that the shaft rotation causes the sight bracket to raise and lower as to alter the distance for which an archer is aiming. The pin and the tongue are in displaceable cooperation such that depression of the pin causes the tongue to disengage from the rotating shaft as to permit quick movement of the sight bracket along the length of the carriage.

10 Claims, 3 Drawing Sheets

LATERAL ADJUSTMENT ARCHERY BOW SIGHT

BACKGROUND OF THE INVENTION

This invention relates to archery bow sights, more specifically archery bow sights that provide for the sight, or part of the sight, to be vertically adjusted.

Archery, whether for hunting or for target shooting, requires using two hands to position a bow in such a manner as to direct the flight of an arrow towards either quarry or a target. In using a bow, an archer must realize and compensate for the rise and fall of an arrow due to trajectory and gravity. As the distances between archer and target increase, the rise and fall of the arrow has a greater importance and requires a greater initial trajectory above horizontal. As the distance becomes greater, it also becomes more difficult for an archer to visually determine both that distance and the proper trajectory for that distance.

Accordingly, archers use bow sights mounted on their bows to help them determine the proper trajectory. Often times, a bow sight has multiple pins, each one having been calibrated for a particular distance. The archer, while practicing at a particular distance, will manually adjust a pin for that distance. When in use, the archer will then approximate the distance to a target and determine how to compensate the trajectory based upon the knowledge of proper trajectory displayed by the multiple pins.

Some bow sights are equipped with a single pin. Often times, these bow sights are either accompanied by calibration marks or fashioned as to allow calibration marks to be made on the sight, each allowing the single pin to be adjusted manually during use to display various proper trajectories for various, corresponding distances.

With a single pin, there are problems with adjustment. Typically, the pin is mounted or positioned within or to a block. The block may be moved by the turning of a threaded shaft or other structure providing for precise positioning. If the movement of the pin or block from two positions, one being a position calibrated for a short distance and the other being a position calibrated for a distance several times the short distance, is only a slight movement, the error involved between the two positions, or between other intermediate positions, can be significant. This makes calibration difficult, if not of specious value.

If, on the other hand, the movement has a greater range, the calibration is excellent and can be done with a high degree of precision. However, as the parts that are moving (ie, the pin or block or rotating threaded shaft) are designed to be precise, this great movement typically requires effort and time that is far from ideal for some archers, for example a hunter who has just sighted quarry.

Ideally, the movement of the pin may be both tuned in very fine degrees as well as moved over a range quickly. Some presently known bow sights provide such ability.

U.S. Pat. No. 5,524,601, to Slates et al., the patent having in common the assignee and one inventor as this invention and being incorporated herein by reference, demonstrates the described ability to be tuned in very fine degrees and moved over a range quickly. This is achieved by having a vertical rotating shaft which is threaded and generally exposed, and a block that abuts and slides against a vertical bar in the direction of the central axis of the vertical rotating shaft, the block also being engaged with a sight pin. The block has a bore transverse to the direction of movement and a non-rotating shaft is positioned within the bore. The non-rotating shaft has a diametral, irregular bore through which the rotating shaft passes. The inner surface of the irregular bore matingly engages with the threads of the rotating shaft when the two are in contact, thus permitting fine tuning of the vertical position of the nonrotating shaft and, hence, the block. In addition, the bore and block are constructed, and the irregular bore has a shape, such that the non-rotating shaft may be displaced so as to disengage the bore from the rotating shaft, and thus permit the quick movement of the block and its pin in a vertical direction over a range.

The '601 patent presents some drawbacks, however. Because the rotating shaft is necessarily exposed to slide through the block and the non-rotating shaft to protrude, the rotating shaft is susceptible to surface damage and dirt, each of which would deleteriously effect the performance, utility, and precision of the sight. Another drawback is that, because the block protrudes, the vertical bar acts as a pivot point. Accordingly, any shock against the block is directly applied as a moment force creating a sheer in the rotating shaft. This, if severe enough, could distort or damage the rotating shaft. This problem is also present for the similarly protruding non-rotating shaft.

Another known bow sight is described in U.S. Pat. No. 5,414,936, to Sappington, with a common assignee to the present invention and incorporated herein by reference. In this bow sight, again the block protrudes, as does a laterally extending shaft with a bore having a rotating shaft located therewithin. Again, this bow sight is susceptible to shock and damage that can hinder or prevent the motion of the rotating shaft.

Furthermore, U.S. Pat. No. 5,657,740, to Slates, et al., incorporated herein by reference, suffers from the same detriments of '601, of which '740 is a continuation-in-part.

BRIEF SUMMARY OF THE INVENTION

One object of the present invention is to provide a sight for an archery bow.

Another object is to provide such a sight allowing for precision in adjusting the distance at which a pin is set.

Another object is to provide a sight allowing for quickly adjusting the distance at which a pin is set.

Another object is to provide a sight with a mechanism for translating a pin relative to the bow wherein the mechanism is minimally susceptible to damage.

These and other objects will become apparent to those skilled in the art in light of the following disclosure and accompanying drawings.

In accordance with the one aspect of the invention, generally stated, an archery bow sight assembly is provided comprising a vertically threaded rotating shaft, means for position indicia, a sight bracket including a tongue threadedly engaged with the shaft so as to respond to the shaft rotation for moving the sight bracket vertically, a pin that is displaceable so as to cooperatively disengage the tongue from the shaft thereby permitting the sight bracket to move independently of the shaft, and a pointer the position of which corresponds to the marking indicia, and means adapted for attaching a sight pin. Preferably, the archery bow sight assembly further includes a first spring and a second spring, wherein the tongue includes a bore for receiving the first spring, and wherein the pin includes a bore for receiving the second spring, the first spring directing the tongue against the shaft so that the tongue is engaged with the shaft.

Preferably, the archery bow sight assembly further includes a third spring wherein the tongue further includes a second bore for receiving the third spring, the first and third springs directing the tongue against the shaft so that the tongue is engaged with the shaft. Preferably, the tongue includes a bridge portion with a sloped profile, and the pin includes a sloped notch in sliding contact with the bridge portion, depression of the pin disengaging the tongue from the shaft.

Further, in accordance with a second aspect of the present invention, an archery bow sight assembly is provided comprising a vertically threaded rotating shaft, a carriage operatively and rotatably supporting the shaft, the carriage having a cavity within which the shaft is located, the carriage having at least one face displaying marking indicia, and the carriage having one side open, and the shaft being recessed from the side open, a sight bracket closely and slidably fitted around a portion of the carriage as to permit movement of the sight bracket relative to the carriage in only the direction of the vertical axis of the carriage, the sight bracket including a tongue threadedly engaged with the shaft so as to respond to the shaft rotation for moving the sight bracket along the carriage, a pin that is displaceable so as to cooperatively dis-engage the tongue from the shaft thereby permitting the sight bracket to move independently of said shaft, and a pointer the position of which corresponds to said marking indicia, and means adapted for attaching a sight pin. Preferably, the archery bow sight assembly further comprises at least one knob secured to the shaft so as to provide means for rotating the shaft. Preferably, the knob is knurled, and preferably the knob includes a polymeric bushing in contact with said carriage. In the preferred embodiment, the carriage includes an annular projection in contact with said bushing. Preferably, the archery bow sight further includes a stop means retarding movement of the knob and shaft and providing discrete positions for the knob and shaft. In the preferred embodiment, the stop means includes a spring and a ball, and the carriage includes a bore for receiving the spring and ball, and notches for receiving the ball such that the spring and the ball retard movement of the knob and the shaft and provide discrete positions for the knob and shaft.

In accordance with a further aspect of the invention, an archery bow sight assembly is provided comprising a vertically threaded rotating shaft, a carriage operatively and rotatably supporting the shaft, the carriage having a cavity within which the shaft is located, the carriage having at least one face displaying marking indicia, and the carriage having one side open, and the shaft being recessed from the side open, a sight bracket closely and slidably fitted around a portion of the carriage as to permit movement of the sight bracket relative to the carriage in only the direction of the vertical axis of the carriage, the sight bracket including a body, at least one bracket sleeve, at least one gasket, the bracket sleeve fitted within the body in sliding contact with the carriage, the gasket fitted between the bracket sleeve and the sight bracket, and a pointer the position of which corresponds to the marking indicia, and means adapted for attaching a sight pin. Preferably, the gasket is elastomeric.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
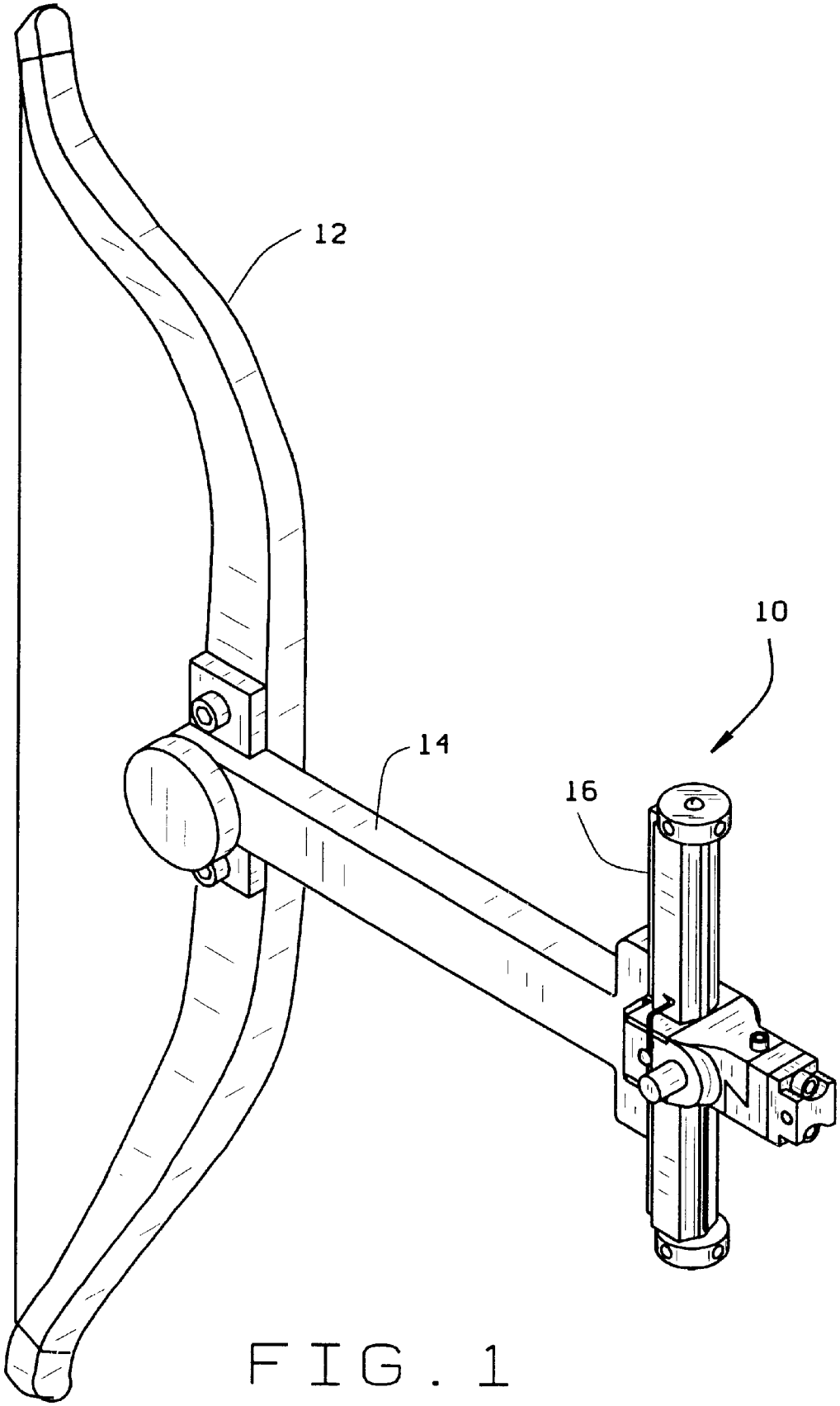
FIG. 1 is a perspective view of a bow sight assembly of the present invention as mounted to an archery bow.

Referring initially to FIG. 1, a bow sight assembly 10 of the present invention is depicted mounted to an archery bow 12 by an arm 14 as is known in the art. The arm 14 may be attached to the bow sight assembly 10 with screws or some other method as is known in the art. The bow sight assembly 10 includes an elongated vertical piece, referred to herein as a carriage 16. In the preferred embodiment of the present invention, the carriage 16 includes a number of threaded holes (not shown) for connecting the carriage 16 to the arm 14.

Figure 2:
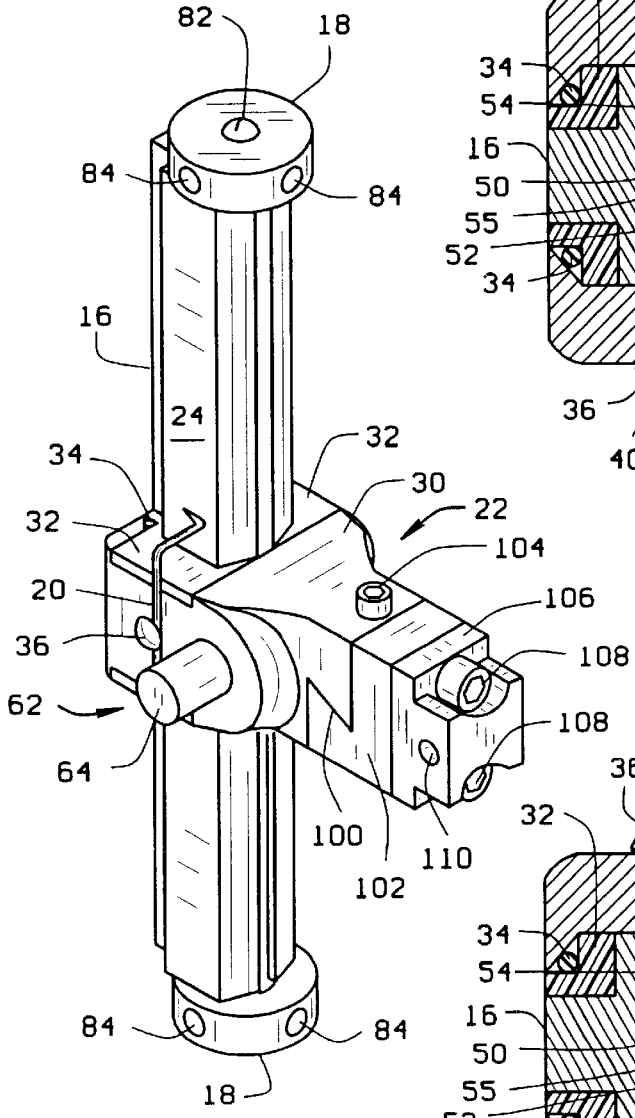
FIG. 2 is a perspective view of the bow sight assembly of the present invention.

Referring now to FIG. 2, the bow sight assembly 10 is shown assembled including the carriage 16, two knurled knobs 18, a pointer 20, and a sight bracket 22. In order for an archer to calibrate the bow sight assembly, the carriage 16 has a plain face 24 and a graduated face 26 (see FIGS. 3 and 4). The plain face 24 and graduated face 26 provide means for marking indicia for indicating the vertical position of the sight bracket 22. The plain face 24 is covered with paper or the like so as to allow an archer to manually mark or scribe indicia for positions. The graduated face 26 has a series of regular indicia or markings and is numbered so as to allow an archer to read the distance for which the sight bracket 22 is set or to determine how to alter the setting of the sight bracket 22. The pointer 20 is secured on the sight bracket 22 such that the pointer 20 corresponds to the indicia. The setting or position of the sight bracket 22 may be adjusted by manual turning of the knobs 18 so as to raise or lower the sight bracket 22.

Figure 3:
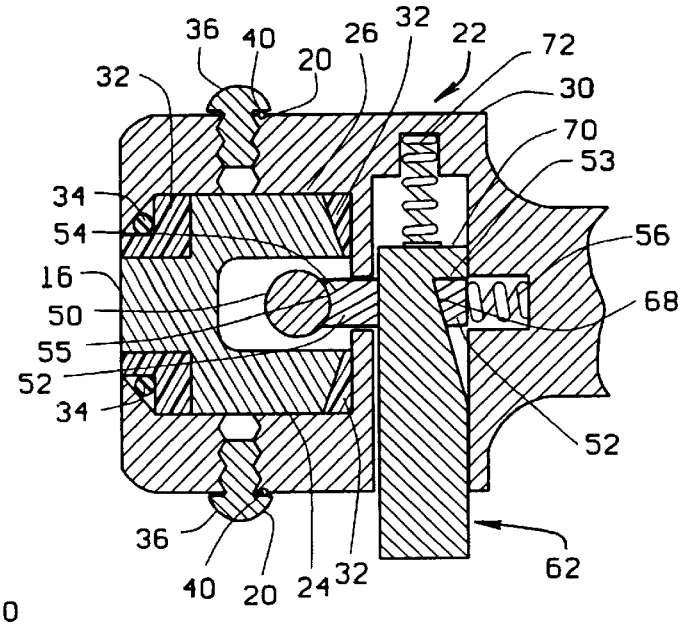
FIG. 3 is a cross-sectional view of the bow sight assembly in an engaged position.

In FIG. 3, a cross-section of the carriage 16 can be seen. The carriage 16 is closely fitted in sliding contact with the sight bracket 22. The sight bracket 22 includes a body 30, two bracket sleeves 32, and two straight gaskets 34. The bracket sleeves 32 are closed fitted within the body 30, and the gaskets 34 are placed between the body 30 and the bracket sleeves 32 (see FIG. 5). The carriage 16 is then slid within the bracket sleeves 32 as to fit slidably close. The gaskets 34 are preferably rubber or other elastomeric material which allows the bracket sleeves 32 to apply pressure to the carriage 16, thereby providing rigidity and stability which are necessary for reliable and precise bow sight calibration.

On two of the sides of the body 30 is one pointer 20 and a mount screw 36. The body 30 includes a threaded hole 38 for each screw 36 (see FIG. 5), and a shallow groove 40 for each pointer 20 in close proximity to the threaded hole 38 so the mount screw 36, when tightened, holds the pointer 20 in place.

Figure 5:
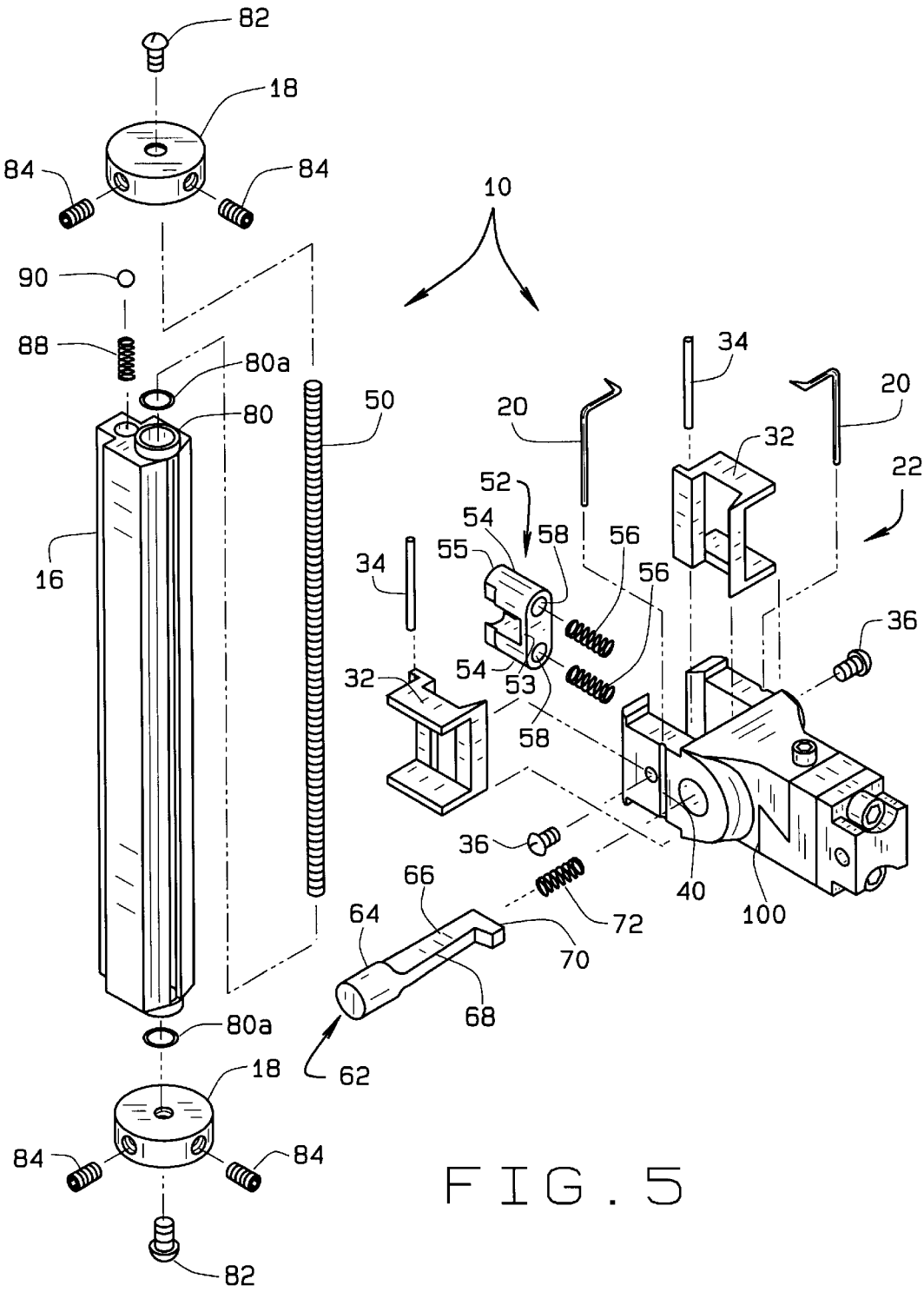
FIG. 5 is an exploded view of the bow sight assembly.

The carriage 16 defines a cavity within which an elongated threaded shaft 50 is positioned. The geometry and construction of the carriage 16 and sight bracket 22 provide rigidity which prevent any stress or shock applied to the sight bracket 22 from bearing on the shaft 50. Each end of the shaft 50 is secured by one of the knobs 18 (see FIG. 5 and accompanying description). As depicted in FIG. 3, the shaft 50 is engaged with a tongue 52. The tongue 52, as can be seen in FIG. 5, has three portions, a bridge portion 53 which has a sloped profile (see also FIG. 5), and two extending portions 54 the end face of each being similarly threaded, as at 55, to mate with the threads of the shaft 50. The tongue 52 may be held in engagement with the shaft 50 with a spring 56 or similar piece so as to allow the tongue and shaft to remain engaged while also allowing the tongue to displace slightly in the case of a stress applied or dirt or other matter which may be on the shaft 50. Preferably, the tongue 52 has two bores 58, each allowing a spring 56 to be placed therewithin (see FIG. 5). As the shaft 50 is turned by a knob 18, the tongue 52 moves in a vertical direction, either up or down depending on the direction of the turning. As the tongue 52 moves, so moves the sight bracket 22 as to adjust the bow sight assembly 10 for varying distances.

The bridge portion 53 abuts a manually operated pin 62. In the preferred embodiment, the pin 62 includes a cylindrical portion 64 which protrudes from the body 30, and an internal portion 66 with two sides that are generally flat so as to be movable between the extending portions 54 of the tongue 52 (see FIG. 5). The internal portion 66 has a sloped notch 68 which abuts the bridge portion 53 of the tongue 52. The pin 62 has an internal end 70 with a bore (not shown) into which a spring 72 is fitted.

Figure 4:
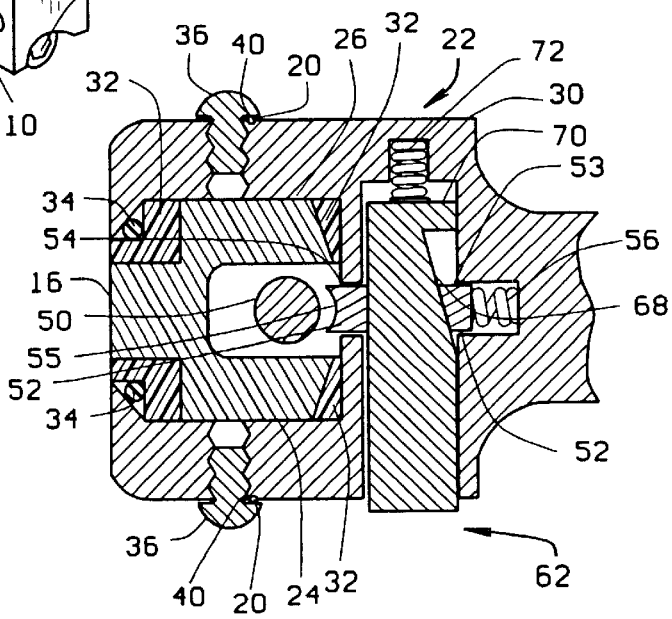
FIG. 4 is a cross-sectional view of the bow sight assembly in a disengaged position.

Referring now to FIG. 4, the tongue 52 is shown disengaged from the shaft 50. In general, the sight bracket 22 may be moved a short, finely-calibrated distance by the turning of the knobs 18. If one desires to move the sight bracket 22 rapidly along the length of the shaft 50, the tongue 52 may be disengaged from the shaft 50. This is accomplished by depressing the pin 62. As the pin 62 is depressed, the spring 72 is compressed, and the sloped notch 68 of the internal portion 66 of the pin 62 causes the bridge portion 53 of the tongue 52 to displace and the springs 56 to be compressed. The sight bracket 22 may then be manually moved vertically.

Referring now to FIG. 5, the sight assembly 10 is depicted showing its assembly. The carriage 16 has an annular projection 80 on each of its vertical ends. Each knob 18 has a polymeric bushing 80a that may be nylon or another similar material and that rests against the projection 80. The shaft 50 is placed within the carriage 16 and is secured to each knob 18 by an end screw 82 passing through the knob 18. The end screws 82 are tightened so that each knob 18 is in frictional contact with the carriage 16 as to minimize unintentional rotation of the bushing against the projection 80. To prevent rotational slippage between the shaft 50 and the knob 18, radial set screws 84 are secured in the knob 18 against the side of the shaft 50.

At least one of the knobs 18 has a stop means which, in the preferred embodiment, comprises a number of "V" shaped notches (not shown) made on the side facing the carriage 16, a spring 88, and a ball 90. The carriage 16 further includes a bore 86 which contains the spring 88 and the ball 90. The spring 88 presses the ball 90 into the notches to further minimize unintentional rotational movement of the knob 18 and, hence, the shaft 50.

In the preferred embodiment, the body 30 has a dovetailed end, as at 100. The sight bracket 22 further includes a pin sight attachment 102. The pin sight attachment 102 has a dove-tailed end mating with the sight bracket 22, as at 102, and which may be attached to the sight bracket 22. In the preferred embodiment, the pin sight attachment 102 is secured by a hexagonal screw 104 which may also be finger-tightened or loosened. In the present embodiment, the pin sight attachment is generally comprised of a second piece 106 secured also by hexagonal screws 108. However, the pin sight attachment 102 may also be a single component, as is obvious to own skilled in the art. In addition, the body 30 of the sight bracket 22 and the pin sight attachment 102 may be a single, integrally formed piece. The second piece 106 of the pin sight attachment 102 includes a horizontal threaded bore 110 which permits a sight pin to be threadedly received therewithin.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. An archery bow sight assembly comprising:

a vertically threaded rotating shaft;

a carriage operatively and rotatably supporting the shaft, said carriage having a cavity within which said shaft is located, said carriage having at least one face displaying marking indicia, and said carriage having one side open, and said shaft being located within said side opening and being recessed from said side opening; a sight bracket closely and slideably fitted around a portion of the carriage so as to permit movement of the sight bracket relative to the carriage in only the direction of the vertical access of the carriage, said sight bracket including a tongue threadedly engaged with said shaft so as to respond to said shaft rotation upon moving said sight bracket along said carriage, a pin that is displaceable so as to cooperatively disengage said tongue from said shaft thereby permitting said sight bracket to move independently of said shaft, and a pointer attached externally to the carriage and positioned to correspond to said marking indicia, and means adapted for attaching a sight pin within the sight bracket;

a knob rotatably mounted upon said carriage and connected to said shaft to provide for its rotation;

a first spring and a second spring, wherein said tongue includes a bore for receiving said first spring, and wherein said pin includes a bore for receiving said second spring, said first spring directing said tongue against said shaft so that said tongue is engaged with said shaft during shaft rotation.

2. The archery bow sight assembly of claim 1 further including a third spring wherein said tongue includes a second bore for receiving said third spring, said first and third springs directing said tongue against said shaft so that said tongue is engaged with said shaft.

3. The archery bow sight assembly of claim 1 wherein said tongue includes a bridge portion with a sloped profile, and wherein said pin includes a sloped notch in sliding contact with said bridge portion, depression of said pin disengaging said tongue from said shaft.

4. The archery bow sight assembly of claim 1 wherein said knob includes a polymeric bushing in contact with said carriage.

5. The archery bow sight assembly of claim 4 wherein said carriage includes an annular projection in contact with said bushing.

6. The archery bow sight assembly of claim 1 including a stop means retarding movement of said knob and shaft and providing discrete positions for said knob and shaft.

7. The archer bow sight assembly of claim 6 wherein stop means includes a spring and a ball, wherein said carriage includes a bore for receiving said spring and ball, and wherein said knob includes notches for receiving said ball such that the spring and the ball retard movement of said knob and said shaft and provide discrete positions for said knob and shaft.

8. The archery bow sight assembly of claim 1 wherein said pin laterally translatable has camming means for cooperatively disengaging said sight bracket from said carriage when laterally translated and for cooperatively engaging said sight bracket with said carriage laterally translated in the opposite direction.

9. An archery bow sight assembly comprising:

a vertically threaded rotating shaft;

a carriage operatively and rotatably supporting the shaft, said carriage having a cavity within which said shaft is located, said carriage having at least one face displaying marking indicia, and said carriage having one side open, and said shaft being recessed within the carriage from the side open;

a knob rotatably mounted upon said carriage and secured to said shaft to provide means for rotating said shaft;

a sight bracket closely and slideably fitted around a portion of the carriage so as to permit movement of the sight bracket relative to the carriage in only the direction of the vertical axis of said carriage, said sight bracket including a body, at least one bracket sleeve, at least one gasket, said bracket sleeve fitted within said body in sliding contact with said carriage, said gasket fitted between said bracket sleeve and said sight bracket, and a pointer connected to said sight bracket and at the position of which corresponds to said marking indicia; and means adapted for attaching a sight pin to said sight bracket.

10. The archery bow sight assembly of claim 9 wherein said gasket is elastomeric.

* * * * *